US006822428B2

(12) United States Patent
Miyanaga et al.

(10) Patent No.: US 6,822,428 B2
(45) Date of Patent: Nov. 23, 2004

(54) STABILIZED POWER SUPPLY UNIT HAVING A CURRENT LIMITING FUNCTION

(75) Inventors: Koichi Miyanaga, Kyoto (JP); Hiroyuki Ishikawa, Kyoto (JP)

(73) Assignee: Rohm Co., LTD, Kyoto (JP)

( * ) Notice: Subject to any disclaimer, the term of this patent is extended or adjusted under 35 U.S.C. 154(b) by 0 days.

(21) Appl. No.: 10/613,935

(22) Filed: Jul. 2, 2003

(65) Prior Publication Data

US 2004/0004467 A1 Jan. 8, 2004

(30) Foreign Application Priority Data

Jul. 8, 2002 (JP) ..... 2002-198281

(51) Int. Cl.[7] ..... G05F 1/44; G05F 1/40
(52) U.S. Cl. ..... 323/284; 323/274; 323/282
(58) Field of Search ..... 323/274, 273, 323/275, 282, 284

(56) References Cited

U.S. PATENT DOCUMENTS 5,777,462 A * 7/1998 Yue ..... 323/284
6,348,783 B2 * 2/2002 Tateishi ..... 323/284
6,472,856 B2 * 10/2002 Groom et al. ..... 323/284
6,559,623 B1 * 5/2003 Pardoen ..... 323/274
6,674,272 B2 * 1/2004 Hwang ..... 323/284
6,690,148 B2 * 2/2004 Harrison ..... 323/284

* cited by examiner

*Primary Examiner*—Bao Q. Vu
(74) *Attorney, Agent, or Firm*—Hogan & Hartson LLP

(57) ABSTRACT

A stabilized power supply unit having a current limiting function, comprising a detection transistor impressed with the same control voltage as the output transistor of the power supply unit, adapted to output a detection current which is exactly proportional to the output current, irrespective of the magnitude of the output current. The current detection transistor is controlled by the control voltage controlling the output transistor. A voltage correction unit is provided to control the voltage of the output end of the current detection transistor, equalizing the voltage with the output voltage. This arrangement provides a detection current exactly proportional to the output current.

15 Claims, 5 Drawing Sheets

STABILIZED POWER SUPPLY UNIT HAVING A CURRENT LIMITING FUNCTION

FIELD OF THE INVENTION

The invention relates to a stabilized power supply unit having a current limiting function for maintaining at a constant level the output voltage supplied to a load if the output current to the load has changed, and restricting excessive output current to the load.

BACKGROUND OF THE INVENTION

A stabilized power supply unit having a current limiting function is widely used in a series regulator serving as a convenient power supply and a constant voltage charging apparatus for charging a battery.

FIG. 4 shows a circuit structure of a series regulator having a conventional current limiting function.

The series regulator shown in FIG. 4 is composed of a voltage control circuit 10, an output circuit 20, and a current limiting circuit 30, integrated on an IC chip.

The voltage control circuit 10 is provided with a differential amplifier Amp and voltage dividing resistors R11 and R12. The differential amplifier Amp is provided at one input thereof (inverting input) with a reference voltage Vref for setting an output voltage, and at another input thereof (non-inverting input) with an output feedback voltage Vfb obtained by dividing the output voltage by the voltage dividing resistors R11 and R12. The difference between the two inputs is amplified by the differential amplifier Amp, and outputted from the voltage control circuit 10 as a control voltage Vc. The differential amplifier Amp is supplied with a constant current from a constant current source 11.

The output circuit 20 has an output transistor Q21 consisting of a p-type MOS transistor (hereinafter referred to as p-type transistor) connected between a power source potential Vdd and the output terminal Po of the power supply unit. The control voltage Vc is applied to the gate of the output transistor Q21. Connected to the output terminal Po is a load Lo and a condenser Co for stabilizing the output to the load.

The current-limiting circuit 30 includes a p-type current detection transistor Q31 and a detection resistor R31 connected in series in the order mentioned, between the power source potential Vdd and the ground. The current limiting circuit 30 is also provided with an n-type MOS transistor (hereinafter referred to as n-type transistor) Q32 having a gate impressed with the voltage drop across the resistor R31. Constant voltage control function of the voltage control circuit 10 is regulated by the operating condition of the n-type transistor Q32.

The detection transistor Q31 is formed together with the output transistor Q21 on the same IC chip with a predetermined ratio less than 1 in size as compared with the output transistor Q21. The gate of the n-type transistor Q31 is impressed with the same control voltage Vc as the gate voltage of the output transistor Q21. As a consequence, a detection current Io' which is practically proportional (e.g. 1/100) to the output current Io flowing through the output transistor Q21 flows through the n-type transistor Q31. The voltage drop across the detection resistor R31 by the detection current Io' determines the operating condition of the n-type transistor Q32. The threshold voltage of the n-type transistor Q32 is set to the voltage that corresponds to the output current (i.e. load current) Io being a preset over-current protection level Is0. The threshold voltage is determined by the ratio of the output current Io and the detection current Io', the resistance of the detection resistor R31, and properties of the n-type transistor Q32.

Operation of the conventional series regulator will be discussed with reference to FIG. 5 showing a characteristic relationship between the output voltage Vo and the output current Io of the regulator. Under normal condition in which the output current Io is below the limit of over-current, the voltage control circuit 10 outputs a control voltage Vc so as to equalize the output feedback voltage Vfb with the reference voltage Vref. This control voltage Vc is applied to the gate of the output transistor Q21 of the output circuit 20 to bring the output voltage Vo to a predetermined set voltage Vs. In this way, the constant voltage control of the regulator can be maintained stable at all times regardless of the magnitude of output current Io, unless the output current Io reaches the over-current protection level Is0.

Under such stable condition, the voltage drop by the detection resistor R31 due to the detection current Io' does not reach the threshold voltage of the n-type transistor Q32. Hence, nothing affects the constant voltage control function of the regulator.

However, as the output current Io reaches the preset over-current protection level Is0, the voltage drop across the detection resistor R31 reaches the operating threshold voltage of the n-type transistor Q32. Thus, the n-type transistor Q32 becomes operative as the output current Io exceeds the over-current protection level Is0. In the voltage control circuit 10, current limiting operation is prioritized, so that the output voltage falls quickly, almost vertically. In this sense, this over-current protection function has a drop-type characteristic. The current level Is1 at which the output voltage fully drops down to Vo is slightly higher (by the amount of $\alpha$) than the preset over-current protection level Is0, in accordance with the gain (control gain) of the current limiting regulator. The region above the level Is0 is an over-current region.

In this way, under normal condition the output voltage Vo is controlled to be at a preset voltage Vs. However, if the output current exceeds a predetermined level (over-current protection level Is0), the output current Io is automatically limited.

However, the drain voltage of the output transistor Q21 will be fixed to a predetermined set voltage Vs even if the output current changes, since the drain voltage is controlled to maintain a constant voltage at all times. On the other hand, the drain voltage of the detection transistor Q31 varies with the detection current Io', since the drain voltage depends on the product of the detection current Io' and the resistance of the detection resistance R31. Thus, even if the gate voltages Vc of the output transistor Q21 and of the detection transistor Q31 are the same, and hence so are the gate-source voltages Vgs, their drain-source voltage Vds can differ.

If the drain-source voltage Vds of the detection transistor Q31 changes, the detection current Io' will be changed according to the inclination of the static drain voltage versus drain current characteristic of the detection transistor Q31, if the gate of the transistor Q31 is impressed with the same gate voltage Vc to the output transistor Q21.

Therefore, the detection current Io' is not exactly proportional to the output current Io. Hence, the output current cannot be limited accurately to an over-current protection level Is0, to which the current should be limited. For this reason, it is often the case that the over-current protection level Is0 is set with some margin, or the output transistor Q21 is provided with a large over-current tolerance.

SUMMARY OF THE INVENTION

It is, therefore, an object of the invention to provide a stabilized power supply unit having a current limiting function, the power supply unit provided with an output transistor and a detection transistor impressed with the same control voltage as the output transistor, making the detection transistor outputting a detection current which is exactly proportional to the output current, thereby enabling accurate detection of the output current.

It is another object of the invention to provide a stabilized power supply unit having a current limiting function, adapted to detect the detection current only if it is necessary, thereby reducing power consumption of the unit.

In accordance with one aspect of the invention, there is provided a stabilized power supply unit for supplying an output voltage, comprising:

a voltage control circuit for outputting a voltage control signal in accordance with the difference between the output feedback voltage associated with the output voltage and a reference voltage;

an output circuit for outputting an output voltage under the control of the voltage control signal; and a current limiting circuit having a current detection unit for passing therethrough a detection current associated with the output current of an output circuit, under the control of the voltage control signal; and a current limiting signal generation unit for generating a current limiting signal to limit the output current when the detection current exceeds a predetermined level, wherein said current limiting circuit is provided with a voltage correction unit connected between the current detection unit and the current limiting signal generation unit, and supplied with the output voltage, and wherein the voltage at the output end of the current detection unit set to, or close to, the output voltage.

The invention is provided with a current source that is enabled by a current-source control signal generated when the output current exceeds a predetermined level which is slightly below the maximum allowable limit of the output current.

In accordance with the invention, thanks to the voltage correction unit, the output voltage of the current detection unit is maintained at the same level as the output voltage at all times. Thus, a detection current exactly proportional to the output current can be obtained, irrespective of magnitudes of the output voltage and the output current. Accordingly, accurate current limitation of the output current can be carried out, limiting it exactly to the targeted over-current protective level.

Further, in accordance with the invention, since the source current is automatically turned off when over-current limitation is unnecessary (that is, when the output current is well below the allowable limit), the power consumption by the stabilized power supply unit can be suppressed. Moreover, whenever limitation of an over-current is required, the current source is securely turned on to enable the voltage correction unit, thereby carrying out an expected over-current limitation.

DETAILED DESCRIPTION OF THE PREFERRED EMBODIMENTS

Figure 1:
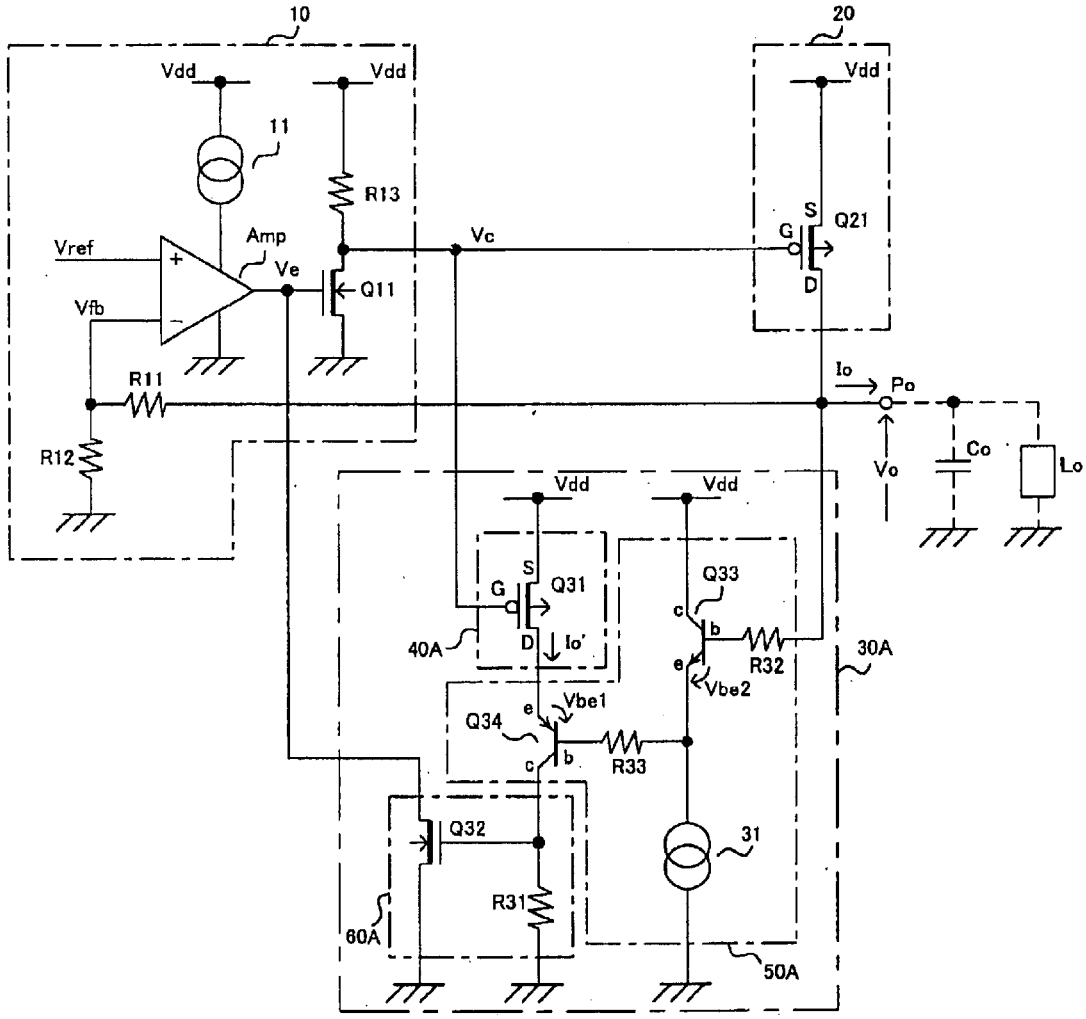
FIG. 1 is a circuit diagram of a series regulator in accordance with a first embodiment of the invention.

The invention will now be described in detail with reference to the accompanying drawings illustrating a stabilized power supply unit having a current limiting function. FIG. 1 shows a series regulator in accordance with a first embodiment of the invention.

This series regulator of FIG. 1 consists of a voltage control circuit 10, an output circuit 20, and a current limiting circuit 30A, all integrated on an IC chip.

The voltage control circuit 10 is provided with a differential amplifier Amp and voltage dividing resistors R11 and R12. One input (non-inverting input) of the differential amplifier Amp is supplied with a reference voltage Vref for setting up an output voltage, while the other input (inverting input) is supplied with an output feedback voltage Vfb generated by dividing the output voltage by voltage dividing resistors R11 and R12. The difference between the two inputs is amplified by the differential amplifier Amp. The amplified output Ve of the differential amplifier Amp is applied to the gate of an n-type transistor Q11 which is connected in series with a resistor R13 as shown. Output from the drain of the n-type transistor Q11 is a voltage control signal (hereinafter referred to as control voltage) Vc, which results from the inversion of the amplified output Ve. The amplified output Ve is controlled by the current limiting signal issued from the current limiting circuit 30A. A current source 11 supplies a constant current to the voltage control circuit 10.

The output circuit 20 is provided with an output transistor Q21 in the form of a p-type transistor connected between a power supply potential Vdd and an output terminal Po. The control voltage Vc is applied to the gate of output transistor Q21. Connected to the output terminal Po are a load Lo and a condenser Co for the stabilization of the output.

The current limiting circuit 30A is provided with a current detection unit 40A for passing therethrough a detection current Io' which is proportional to the output current Io under the control of the control voltage Vc;

a voltage correction unit 50A supplied with the output voltage Vo and adapted to set the voltage of the output end of the current detection unit 40A to, or close to, the output voltage Vo; and a current limiting signal generation unit 60A for generating a current limiting signal to limit the output current Io when the detection current Io' exceeds a predetermined level, in such a way that the current detection unit 40A, voltage correction unit 50A, and current limiting signal generation unit 60A are connected in series between the power supply potential Vdd and the ground.

The current detection unit 40A has a current detection transistor Q31 of the same type and of the same conduction type (p-type) as the output transistor Q21. The current detection unit 40A is formed to control the current detection transistor Q31 by the control voltage Vc, thereby generating the detection current Io' proportional to the output current Io.

The current limiting signal generation unit 60A includes a detection resistor R31 for passing therethrough the detection current Io' and an n-type transistor Q32 having a gate impressed with the voltage drop across the detection resistor R31. The n-type transistor (hereinafter referred to as current limiting signal generating transistor) Q32 is provided to generate a current limiting signal when the voltage drop across the detection resistor R31 reaches the threshold level of the n-type transistor Q32. The amplified output Ve of the differential amplifier Amp is adjusted by this current limiting signal.

It is noted that, in limiting the output current Io, the same current-limiting function may be obtained by regulating either the reference voltage Vref or the output-feedback voltage Vfb using the current limiting signal of the current-limiting circuit 30A, instead of controlling the amplified output voltage Ve. In this case, it is possible to avoid an incidence that the differential amplifier Amp reaches its upper limit (or saturation) of amplification, thereby ensuring a smooth recovery of normal operating condition from an over-current limiting condition.

To do so, a separate constant current circuit may be provided such that the level of the constant current is controlled using the current limiting signal. By supplying the regulated current to either one of the voltage diving resistors R11 and R12, the output feedback voltage Vfb can be regulated. Alternatively, an offset voltage that can be varied in accordance with the current-limiting signal may be added to, or subtracted from, the reference voltage Vref or the output feedback voltage Vfb. In this way, current-limiting function can be attained on the input side of the differential amplifier Amp by controlling the reference voltage Vref or the output feedback voltage Vfb.

The voltage correction unit 50A has a pnp-type bipolar transistor (hereinafter referred to as pnp-transistor) Q34 connected between, and in series with, the current detection unit 40A and the current limiting signal generation unit 60A, a npn-type bipolar transistor (hereinafter referred to as npn-transistor) Q33 connected in series with a constant current source 31 both connected between the power source potential Vdd and the ground. The node of the transistor Q33 and the constant current source 31 is connected to the base of the pnp-transistor Q34 via a low-resistance resistor R33. Further, the output voltage Vo is applied to the base of the npn-transistor Q33 via a low-resistance resistor R32. It should be understood that the current passed through for voltage correction need not be constant. The constant current source 31 can be replaced by any current source so long as the current source can provide a certain amount of current.

In the voltage correction unit 50A, the voltage Vbe1 across the base and the emitter (referred to as base-emitter voltage) of the pnp-transistor Q34, and the base-emitter voltage Vbe2 of the npn-transistor Q33 are substantially the same. The resistors R32 and R33 provide almost the same small voltage drops. For this reason, the drain voltage of the p-type transistor Q31 of the current detection unit 40A always becomes substantially the same as the output voltage Vo, when the output voltage Vo is maintained at the set voltage Vs and even when the output voltage Vo is quickly dropping in a "vertically dropping" manner in the over-current protection mode.

Operation of the series regulator of FIG. 1 will now be described.

Figure 4:
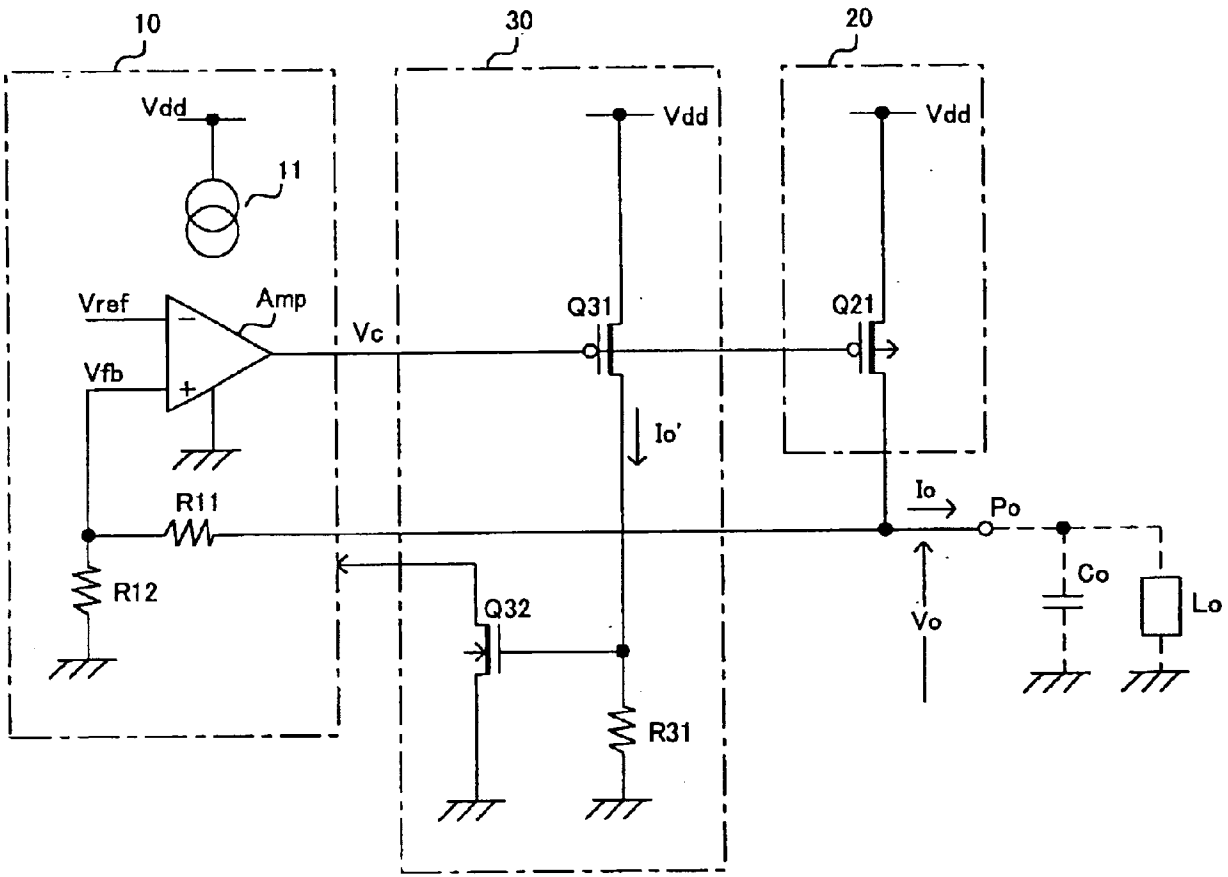
FIG. 4 PRIOR ART
FIG. 4 is a circuit diagram of a conventional series regulator.
Figure 5:
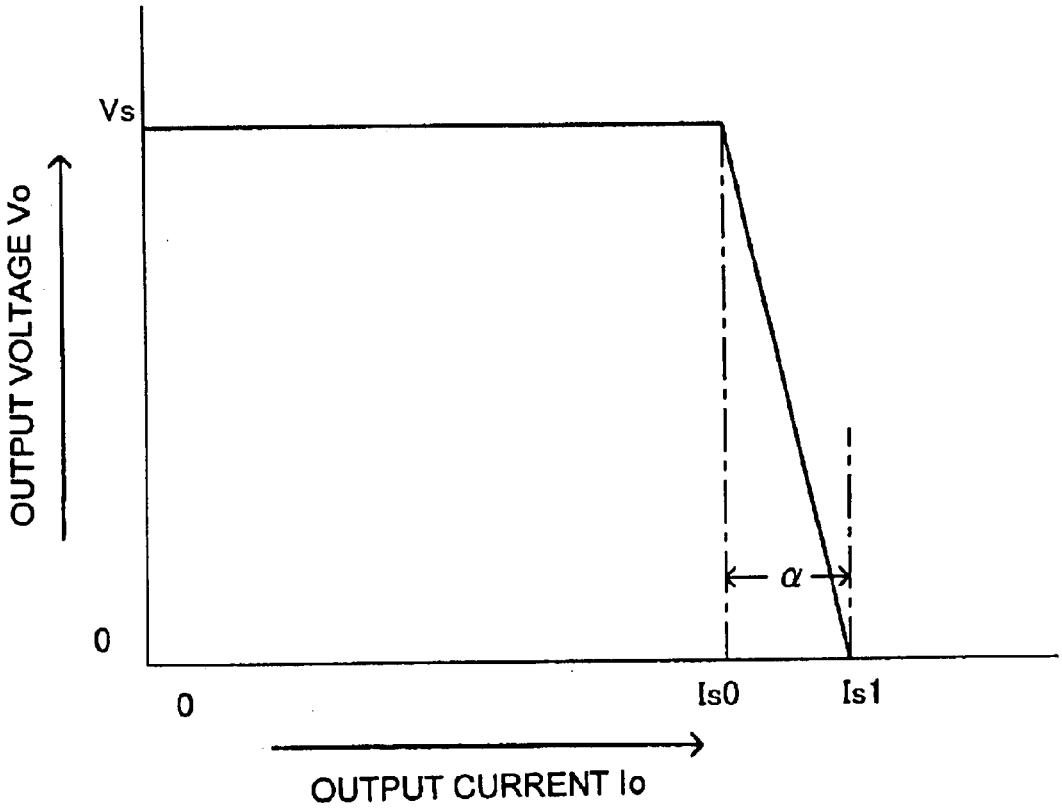
FIG. 5 PRIOR ART
FIG. 5 is a graph showing the output voltage versus output current characteristic of the conventional series regulator.

Under normal operating condition in which the output current Io is below the permissible limit (i.e. below the over-current protection level Is0), the voltage control circuit 10 operates in the same way as the conventional one as shown in FIG. 4. Therefore, the constant voltage control of the regulator can be maintained stable at all times regardless of the magnitude of output current Io, unless the output current Io reaches the over-current protection level Is0.

In the example shown herein, the voltage Vds across the source and the drain (referred to as source-drain voltage) of the current detection transistor Q31 is equalized to the source-drain voltage Vds of the output transistor Q21 by the voltage correction unit 50A. Thus, the current detection transistor Q31 and the output transistor Q21 are driven under the same condition. Therefore, the detection current Io' is precisely proportional to the output current Io at all times.

The voltage drop across the detection resistor R31 due to the detection current Io' will not reach the threshold level of the n-type transistor Q32 and hence will not affect the operation of the power supply unit providing a constant voltage at all, until the output current Io reaches the over-current protection level Is0.

If, however, as the load increases under normal operating condition, the output current Io can reach the over-current protection level Is0, then the detection current Io', which is proportional to Is0, increases to a certain level that causes the voltage drop across the detection resistor R31 to reach the threshold level of n-type transistor Q32. Then, the n-type transistor Q32 is enabled to generate a current limiting signal, as described above.

As the n-type transistor Q32 is enabled, the amplified output Ve decreases, while the control voltage Vc increases. This reduces the conductivity of the output transistor Q21, and hence the output voltage Vo, thereby limiting the output current Io.

In this way, the detection current Io', precisely proportional to the output current Io, can be obtained by the voltage correction unit 50A. Therefore, accurate current limitation of the output current to the prescribed over-current limitation level Is0 is secured, irrespective of the magnitude of the output current Io.

Figure 2:
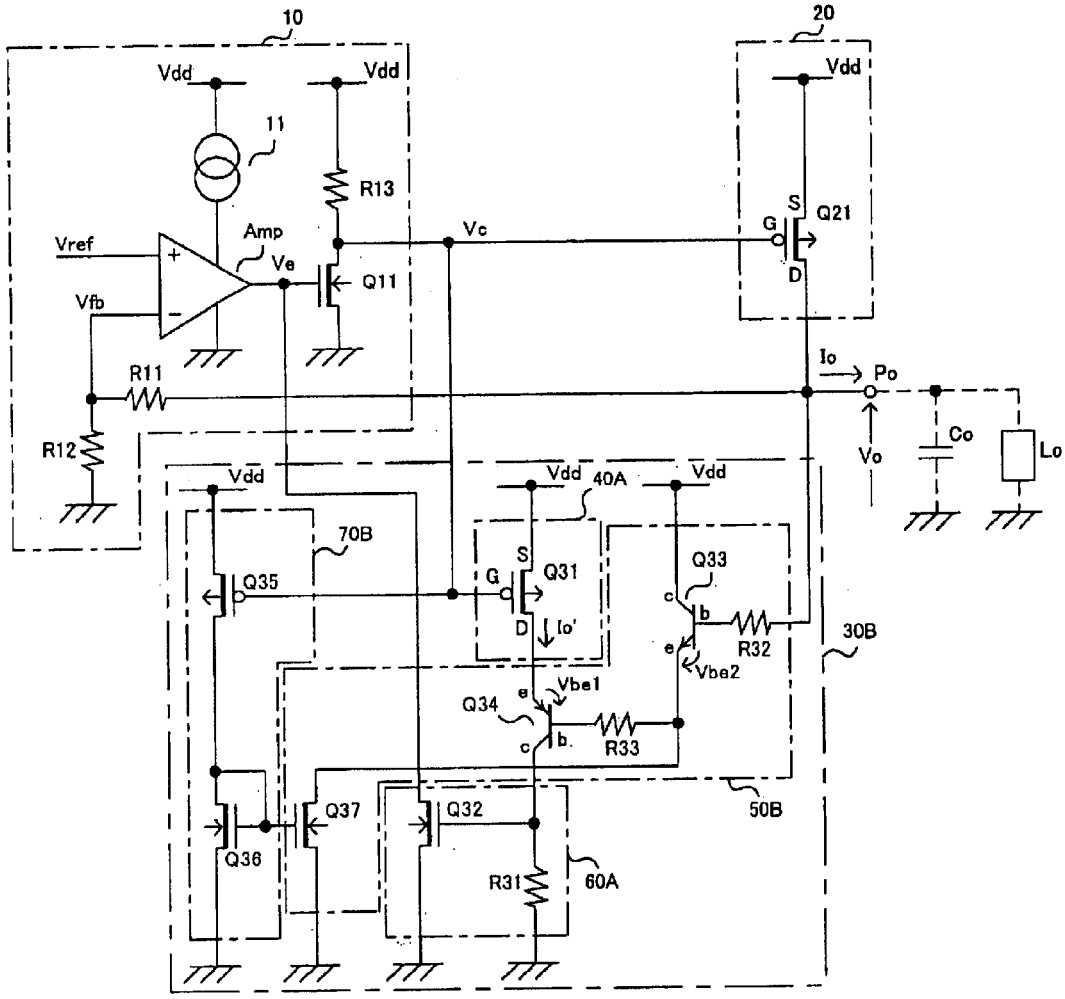
FIG. 2 is a circuit diagram of a series regulator in accordance with a second embodiment of the invention.

FIG. 2 shows a second embodiment of a series regulator according to the invention. This embodiment has a feature to reduce wasteful power consumption of the series regulator.

In the first embodiment shown in FIG. 1, the voltage correction unit 50A is designed to provide a detection current Io' which is precisely proportional to the output current. However, it is necessary to constantly feed a constant current from the constant current source 31 to the voltage correction unit 50A. Since this current is necessary only when over-current detection is carried out, it is wasting of energy to supply the current while the output current Io is small. Therefore, in the second embodiment, the constant current for the voltage correction unit is cut off while the output current Io is small, thereby saving energy.

As shown in FIG. 2, the voltage control circuit 10 and the output circuit 20 are respectively the same as the corresponding circuits of FIG. 1, and only the structure of the current limiting circuit 30B differs from the corresponding current limiting circuit 30A.

The current limiting circuit 30B has an n-type transistor Q37 serving as a current source for the voltage correction unit 50B. In order to turn on and off the n-type transistor Q37 in accordance with the magnitude of the output current Io, a current-source control unit 70B is provided.

The current-source control unit 70B is provided with a series circuitry of a current-source detection transistor (current-source control transistor) Q35 and an n-type transistor Q36 serving as a current-to-voltage converter, connected between the power source potential Vdd and the ground.

The current-source detection transistor Q35 is a p-type transistor of the same conduction type as the current detection transistor Q31, and has a gate impressed with the control voltage Vc. The n-type transistor Q36 has a diode-connected configuration, in which the diode and the drain are connected together. The gate voltage of the n-type transistor Q36 is supplied to the gate of the n-type transistor Q37.

In this arrangement, a current flows through the current source detection transistor Q35, which is substantially proportional to the output current Io and the detection current Io'. Then the voltage converted by the n-type transistor Q36 from this current is applied to the gate of the n-type transistor Q37. Hence, the voltage correction unit 50B will become operative when the applied voltage exceeds the operating threshold of the transistor. In order to ensure over-current limitation, the threshold level of the n-type transistor Q37 is preferably set to be corresponding to the output current Io slightly below the over-current protection level Is0.

The output voltage Vo of the series regulator shown in FIG. 2 is always controlled to the preset voltage Vs in accordance with the reference voltage Vref. Under this condition, if no load or a small load is connected, the output current Io is small and the n-type transistor Q37 is impressed on the gate thereof with a voltage that is well below its threshold level. Therefore, the n-type transistor Q37 will remain in the OFF state, and no current will flow to the voltage correction unit 50B. In this way, when the regulator is free of load or loaded with a very small load, no current is needed to perform the current limitation, i.e. the current for voltage correction is not necessary, so that the wasteful source of power may be cut off by turning off the n-type transistor Q37.

On the other hand, when the output current Io has increased to a sufficiently high level, there is a chance that the output current Io will reach the current limitation level, requiring a current limitation. Under such condition, to prepare for prompt execution of accurate over-current limitation, the n-type transistor Q37 is turned on, providing a necessary current to the voltage correction unit 50B. Thus, as soon as the output current Io reaches the over-current protection level Is0, the over-current limitation will be executed promptly and securely.

It should be understood that the voltage correction unit 50B may be turned on and off not only by the current source as shown in FIG. 2, but also by an alternative means. For example, a switching means can be used that turns on and off according to whether the control voltage Vc has exceeded a certain level or not in association with the output current Io.

Figure 3:
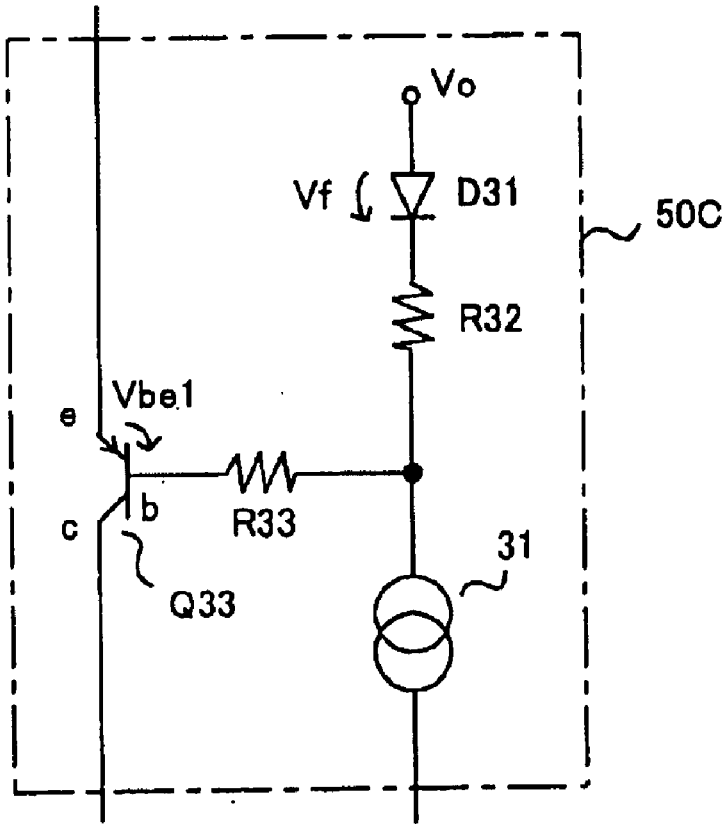
FIG. 3 shows an alternative circuitry of a voltage correction unit.

FIG. 3 shows a voltage correction unit 50C that can be used as an alternative to the first voltage correction unit 50A and the second voltage correction unit 50B described above.

The voltage correction unit 50C of FIG. 3 only differs from the voltage correction units 50A and 50B in that a diode D31 is used in the unit 50C in place of the npn-transistor Q33. The output voltage Vo applied to the transistor Q33 is now applied to the diode D31. It is noted that the base-emitter voltage Vbe1 across the pnp-type transistor Q34 of the preceding voltage correction units 50A and 50B can be implemented substantially by the voltage drop Vf in the forward direction across the diode D31. Thus, the voltage correction unit 50C provides a similar voltage correcting function.

What we claim is:

1. A stabilized power supply unit for supplying an output voltage, comprising:

a voltage control circuit for outputting a voltage control signal in accordance with the difference between the output feedback voltage associated with said output voltage and a reference voltage;

an output circuit for outputting said output voltage under the control of said voltage control signal; and a current limiting circuit having a current detection unit for passing therethrough a detection current associated with said output current of the output circuit, under the control of said voltage control signal; and a current limiting signal generation unit for generating a current limiting signal to limit said output current when said detection current exceeds a predetermined level, wherein said current limiting circuit is provided with a voltage correction unit connected between said current detection unit and said current limiting signal generation unit, and supplied with said output voltage, and wherein the voltage at the output end of said current detection unit set to, or close to, said output voltage.

2. The stabilized power supply unit according to claim 1, wherein said output circuit has an output transistor connected between a power source and the output terminal of said power supply unit, adapted to control said output transistor by said voltage control signal to output a constant output voltage from said output transistor;

said current detection unit has a current detection transistor of the same type and of the same conduction type as said output transistor, and controls said current detection transistor by said voltage control signal to obtain a detection current proportional to said output current.

3. The stabilized power supply unit according to claim 2, wherein said voltage correction unit has a first transistor provided between said current detection unit and said current limiting signal generation unit;

a second transistor supplied with said output voltage as a control input signal to control said first transistor; and a current source for driving said first and second transistors.

4. The stabilized power supply unit according to claim 3, wherein said current source is enabled by a current-source control signal generated when said output current exceeds a predetermined current level set below the allowable maximum output current of said power supply unit.

5. The stabilized power supply unit according to claim 4, wherein said current-source control signal is generated based on the level of said voltage control signal.

6. The stabilized power supply unit according to claim 4, further comprising a current-source control circuit having:

a current-source control transistor having the same type and same conduction type as said current detection transistor, and adapted to be controlled by said voltage control signal; and conversion means, connected in series with said current-source control transistor, for converting the current passing through said current-source control transistor into said current-source control signal.

7. The stabilized power supply unit according to claim 3, wherein said current source is a constant current source.

8. The stabilized power supply unit according to claim 2, wherein said voltage correction unit has a first transistor provided between said current detection unit and said current limiting signal generation unit;

voltage dropping element for supplying said output voltage as a control input signal to said first transistor; and a current source for driving said first transistor and said voltage dropping element.

9. The stabilized power supply unit according to claim 8, wherein said voltage dropping element is a diode.

10. The stabilized power supply unit according to claim 9, wherein said current source is enabled by a current-source control signal generated when said output current exceeds a predetermined current level set below the maximum allowable limit of said output current.

11. The stabilized power supply unit according to claim 10, wherein said current-source control signal is generated based on the level of said voltage control signal.

12. The stabilized power supply unit according to claim 10, further comprising a current-source control circuit having:

a current-source control transistor having the same type and same conduction type as said current detection transistor, and adapted to be controlled by said voltage control signal; and conversion means, connected in series with said current-source control transistor, for converting the current passing through said current-source control transistor into said current-source control signal.

13. The stabilized power supply unit according to claim 9, wherein said current source is a constant current source.

14. The stabilized power supply unit according to claim 1, wherein said voltage control circuit has a differential amplifier for amplifying the difference between said output feedback voltage and said reference voltage to output said voltage control signal in accordance with said difference, and said current limiting signal is coupled to said voltage control circuit so as to regulate the amplified output of said differential amplifier.

15. The stabilized power supply unit according to claim 1, wherein said voltage control circuit has a differential amplifier for amplifying the difference between said output feedback voltage and said reference voltage to output said voltage control signal in accordance with said difference, and said current limiting signal is coupled to said voltage control circuit so as to regulate either one of said output feedback voltage and said reference voltage.

* * * * *